US011162051B2

(12) United States Patent
Hirooka et al.

(10) Patent No.: US 11,162,051 B2
(45) Date of Patent: Nov. 2, 2021

(54) GREASE COMPOSITION

(71) Applicant: KYODO YUSHI CO., LTD., Fujisawa (JP)

(72) Inventors: Iwaki Hirooka, Fujisawa (JP); Yuta Sato, Fujisawa (JP); Masatoshi Ijima, Fujisawa (JP)

(73) Assignee: KYODO YUSHI CO., LTD., Fujisawa (JP)

( * ) Notice: Subject to any disclaimer, the term of this patent is extended or adjusted under 35 U.S.C. 154(b) by 0 days.

(21) Appl. No.: 16/321,976

(22) PCT Filed: Aug. 4, 2017

(86) PCT No.: PCT/JP2017/028345

§ 371 (c)(1),
(2) Date: Jan. 30, 2019

(87) PCT Pub. No.: WO2018/025981

PCT Pub. Date: Feb. 8, 2018

(65) Prior Publication Data

US 2019/0177645 A1 Jun. 13, 2019

(30) Foreign Application Priority Data

Aug. 4, 2016 (JP) ..... JP2016-153750

(51) Int. Cl.

| | |
|---|---|
| ***C10M 169/00*** | (2006.01) |
| ***C10M 133/40*** | (2006.01) |
| ***C10M 141/06*** | (2006.01) |
| ***C10M 101/02*** | (2006.01) |
| ***C10M 133/12*** | (2006.01) |
| ***C10M 115/08*** | (2006.01) |
| ***C10M 119/24*** | (2006.01) |
| ***C10M 129/46*** | (2006.01) |
| ***C10M 149/10*** | (2006.01) |
| ***C10M 161/00*** | (2006.01) |
| *C10N 30/02* | (2006.01) |
| *C10N 30/10* | (2006.01) |
| *C10N 30/12* | (2006.01) |
| *C10N 40/02* | (2006.01) |
| *C10N 50/10* | (2006.01) |

(52) U.S. Cl.

CPC ..... *C10M 169/00* (2013.01); *C10M 101/02* (2013.01); *C10M 115/08* (2013.01); *C10M 119/24* (2013.01); *C10M 129/46* (2013.01); *C10M 133/12* (2013.01); *C10M 133/40* (2013.01); *C10M 141/06* (2013.01); *C10M 149/10* (2013.01); *C10M 161/00* (2013.01); *C10M 2203/1006* (2013.01); *C10M 2207/126* (2013.01); *C10M 2215/26* (2013.01); *C10M 2215/30* (2013.01); *C10M 2217/028* (2013.01); *C10M 2217/0456* (2013.01); *C10N 2030/02* (2013.01); *C10N 2030/10* (2013.01); *C10N 2030/12* (2013.01); *C10N 2040/02* (2013.01); *C10N 2050/10* (2013.01)

(58) Field of Classification Search

CPC ..... C10N 2040/02

See application file for complete search history.

(56) References Cited

U.S. PATENT DOCUMENTS

| | | | | |
|---|---|---|---|---|
| 2,908,646 | A * | 10/1959 | Roach | C10M 5/00 508/221 |
| 6,235,686 | B1 * | 5/2001 | Karol | C08G 73/0627 508/244 |
| 6,726,855 | B1 | 4/2004 | Migdal et al. | |
| 9,012,386 | B2 | 4/2015 | Saita et al. | |
| 10,597,598 | B2 | 3/2020 | Ito et al. | |
| 2006/0128574 | A1 | 6/2006 | Dong et al. | |
| 2011/0136578 | A1 | 6/2011 | Kawamura | |
| 2011/0183876 | A1 | 7/2011 | Imai et al. | |
| 2012/0314985 | A1 * | 12/2012 | Saita | C10M 169/06 384/490 |
| 2012/0331306 | A1 | 12/2012 | Harris | |
| 2013/0331306 | A1 | 12/2013 | Aida et al. | |
| 2013/0345101 | A1 | 12/2013 | Imai et al. | |
| 2014/0199009 | A1 * | 7/2014 | Inami | C10M 169/02 384/462 |
| 2018/0230396 | A1 | 8/2018 | Ito et al. | |

FOREIGN PATENT DOCUMENTS

| | | | |
|---|---|---|---|
| CN | 1444641 | A | 9/2003 |
| CN | 101952401 | A | 1/2011 |
| CN | 102770514 | A | 11/2012 |
| CN | 103242942 | B | 8/2014 |
| EP | 1 137 747 | A1 | 10/2001 |
| EP | 2264132 | A1 | 12/2010 |
| EP | 2 631 284 | A1 | 8/2013 |
| EP | 2 687 584 | A1 | 1/2014 |
| JP | 11-222597 | A | 8/1999 |
| JP | 2002-531632 | A | 9/2002 |
| JP | 2010-077320 | A | 4/2010 |
| JP | 2010-084142 | A | 4/2010 |
| JP | 2012-087221 | A | 5/2012 |
| JP | 2012-197401 | A | 10/2012 |
| WO | 00/32724 | A1 | 6/2000 |
| WO | 2012/124815 | A1 | 9/2012 |
| WO | 2017/026299 | A1 | 2/2017 |

OTHER PUBLICATIONS

International Search Report (PCT/ISA/210) dated Oct. 24, 2017, by the Japan Patent Office as the International Searching Authority for International Application No. PCT/JP2017/028345.

Written Opinion (PCT/ISA/237) dated Oct. 24, 2017, by the Japan Patent Office as the International Searching Authority for International Application No. PCT/JP2017/028345.

Extended European Search Report dated Mar. 25, 2020, by the European Patent Office in corresponding European Patent Application No. 17837082.1. (8 pages).

(Continued)

*Primary Examiner* — Vishal V Vasisth

(74) *Attorney, Agent, or Firm* — Buchanan, Ingersoll & Rooney PC

(57) ABSTRACT

The present invention provides a grease composition comprising (a) a base oil, (b) a thickener comprising a urea compound, (c) an amine antioxidant at 0.5 to 5% by mass based on a total mass of the composition, and (d) a quinoline antioxidant at 0.5 to 5% by mass based on the total mass of the composition.

11 Claims, No Drawings

(56) References Cited

OTHER PUBLICATIONS

The First Office Action dated Mar. 29, 2021, by the State Intellectual Property Office of the People's Republic of China in corresponding Chinese Patent Application No. 201780048446.3 and an English translation of the Action. (16 pages).

The Second Office Action dated Aug. 25, 2021, by the State Intellectual Property Office of People's Republic of China in corresponding Chinese Patent Application No. 201780048446.3, and a machine English translation of the Office Action. (18 pages).

* cited by examiner

GREASE COMPOSITION

This application is a 371 of PCT/JP2017/028345, filed Aug. 4, 2017.

TECHNICAL FIELD

The present invention relates to a grease composition suitably usable for rolling bearings that support motor rotors used in electrical instruments and machine parts used in various industries.

BACKGROUND ART

Motors used in various industrial machines are operated in various environments ranging from cold climates to high temperature atmospheres such as the inside of the engine room of an automobile. For this reason, bearings used in the motors are required to be usable in a wide range of temperature without needing maintenance for a long period of time, and are therefore facing an increasing need for the durability.

A grease composition used as a lubricant for mechanical parts and the like is generally composed of three components: a thickener, a base oil, and an additive.

What is necessary to obtain a grease achieving a long life under high temperature is to improve the oxidation resistance of the grease. For example, a grease using a urea compound as a thickener and a specific amount of overbased metal sulfonate as an additive has been proposed as a grease useable for a rolling bearing used at high temperature (Patent Literature 1). A grease using an alicyclic aliphatic diurea compound as a thickener and a high-performance synthetic oil, namely, a pentaerythritol ester oil as a base oil has also been proposed for prolonging the seizure life under severe conditions such as high temperature and high speed (Patent Literature 2).

Since the temperature and speed at which machine parts are to operate have become higher and higher in recent years, a demand for the longer life of rolling bearings has become stronger than ever. Moreover, in order to be used for all the purposes, the grease has been required to maintain its performance in a wide range of temperature irrespective of the oxidation resistance (type) of the base oil.

Patent Literature 3 has proposed a biodegradable grease composition using an amine: N-phenyl-1-naphthylamine and a quinolone: poly(2,2,4-trimethyl-1,2-dihydroquinoline) as antioxidants. However, Patent Literature 3 has merely aimed at imparting the biodegradability to the grease composition, and just evaluated the bearing lubrication life, which is an index of the durability of the bearing, under the environment at 100° C.

CITATION LIST

Patent Literatures

Patent Literature 1: Japanese Patent Application Publication No. 2010-77320

Patent Literature 2: Japanese Patent Application Publication No. 2012-197401

Patent Literature 3: Japanese Patent Application Publication No. H11-222597

SUMMARY OF INVENTION

Problems to be Solved by the Invention

Under these circumstances, the present invention has an object to provide a long-life grease composition that is excellent in durability under an environment at high temperature and high speed and also excellent in low temperature properties.

Means for Solution of the Problems

The present invention provides the following grease compositions.

1. A grease composition comprising:
   (a) a base oil;
   (b) a thickener comprising a urea compound;
   (c) an amine antioxidant at 0.5 to 5% by mass based on a total mass of the composition; and
   (d) a quinoline antioxidant at 0.5 to 5% by mass based on the total mass of the composition.
2. The grease composition according to the above section 1, wherein the (b) thickener comprising a urea compound is a diurea compound represented by the following formula (1):

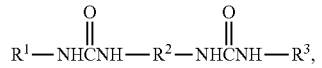

$$R^1-NHC(=O)NH-R^2-NHC(=O)NH-R^3, \quad (1)$$

where $R^2$ is a divalent aromatic hydrocarbon group having 6 to 15 carbon atoms, and $R^1$ and $R^3$ may be the same or different from each other, and each are a saturated or unsaturated alkyl group having 6 to 30 carbon atoms, an aryl group having 6 or 7 carbon atoms, or a cyclohexyl group.

3. The grease composition according to the above section 1 or 2, wherein the (a) base oil contains at least one selected from the group consisting of mineral oils and hydrocarbon synthetic oils.
4. The grease composition according to the above section 1 or 2, wherein the (a) base oil contains a highly refined mineral oil.
5. The grease composition according to any one of the above sections 1 to 4, wherein the (a) base oil has a kinematic viscosity of 50 to 150 $mm^2/s$ at 40° C.
6. The grease composition according to any one of the above sections 1 to 5, wherein the (c) amine antioxidant is at least one amine antioxidant selected from the group consisting of phenyl-α-naphthyl amine, alkyl phenyl-α-naphthyl amine, and alkyl diphenyl amine.
7. The grease composition according to any one of the above sections 1 to 6, wherein the (d) quinoline antioxidant is at least one quinoline antioxidant selected from the group consisting of 2,2,4-trimethyl-1,2-dihydroquinoline, 2-methyl-2,4-diethyl-1,2-dihydroquinoline, 2,2,4,6-tetramethyl-1,2-dihydroquinoline, 2,2,4,7-tetramethyl-1,2-dihydroquinoline, 6,6'-bis(2,2,4-trimethyl-1,2-dihydroquinoline), derivatives thereof, and polymers thereof.
8. The grease composition according to any one of the above sections 1 to 7, wherein a mass ratio between the (c) amine antioxidant and the (d) quinoline antioxidant is 1:3 to 3:1.
9. The grease composition according to any one of the above sections 1 to 8, further comprising (e) a zinc rust inhibitor, wherein a content of the zinc rust inhibitor is 0.5 to 10% by mass based on the total mass of the grease composition.
10. The grease composition according to any one of the above sections 1 to 9, which is for use for a rolling bearing for a motor which supports a rotor of the motor.

Advantageous Effects of Invention

According to the present invention, it is possible to provide a long-life grease composition that is excellent in durability under an environment at high temperature and high speed and also excellent in low temperature properties.

DESCRIPTION OF EMBODIMENTS

<Base Oil>

A base oil used in a grease composition of the present invention is not particularly limited. For example, all types of base oils including mineral oils may be used. Preferably, the base oil comprises at least one selected from the group consisting of mineral oils and hydrocarbon synthetic oils. These base oils may be each used alone or be used in combination of two or more.

A usable mineral oil is a paraffinic mineral oil, a naphthenic mineral oil, or a mixture of them. The base oil preferably contains a highly refined mineral oil.

The highly refined mineral oil refers to a mineral oil dewaxed to reduce precipitation of the wax components at low temperature, and thereby having a pour point lower than the pour point (about −5° C. to −20° C.) of an unrefined mineral oil. Comprising a highly refined mineral oil having a pour point of −35° C. or lower, the grease composition can be used without having adverse effects on the low torque properties at low temperature. In addition, the grease composition can be used without having a problem on the evaporation resistance. Here, the pour point of the base oil can be measured in accordance with JIS K 2269.

A content ratio of the highly refined mineral oil to the total mass of the base oil taken as 100 is preferably 5 to 30% by mass and more preferably 10 to 20% by mass. When the highly refined mineral oil is contained at the above ratio, the grease composition can obtain good low temperature properties.

As the synthetic oil, various synthetic oils may be used such as: ester synthetic oils typified by diester and polyol ester; synthetic hydrocarbon oils typified by poly α-olefin and polybutene; ether synthetic oils typified by alkyl diphenyl ether and polypropylene glycol; silicone oils; and fluorinated oils. Among them, a synthetic hydrocarbon oil, an ester oil, an ether synthetic oil, and a mixture of them are preferable. A synthetic hydrocarbon oil, an ester oil, and a mixture of them are more preferable. A synthetic hydrocarbon oil and a mixture oil of a synthetic hydrocarbon oil and another oil are even more preferable.

To use a single mineral oil alone as the base oil of the present invention is particularly preferable. It is more preferable that the base oil contain a highly refined mineral oil.

The kinematic viscosity of the base oil of the present invention is not particularly limited. The kinematic viscosity of the base oil can be selected as needed. The kinematic viscosity of the base oil at 40° C. is preferably 10 to 200 $mm^2/s$, more preferably 50 to 150 $mm^2/s$, and even more preferably 70 to 100 $mm^2/s$. Here, the kinematic viscosity of the base oil can be measured in accordance with the section 23. in JIS K2220

In the grease composition of the present invention, the content of the base oil is preferably 70 to 90% by mass and more preferably 80 to 90% by mass.

<Thickener>

The thickener used in the grease composition of the present invention is a urea thickener. Among urea thickeners, a diurea compound represented by the following formula (1) is preferable.

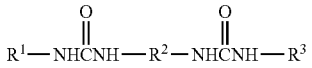

$$R^1-NHC(=O)NH-R^2-NHC(=O)NH-R^3 \quad (1)$$

In the formula, $R^2$ is a divalent aromatic hydrocarbon group having 6 to 15 carbon atoms, and $R^1$ and $R^3$ may be the same or different from each other, and each are a saturated or unsaturated alkyl group having 6 to 30 carbon atoms, an aryl group having 6 or 7 carbon atoms, or a cyclohexyl group.

A particularly preferable one is an alicyclic aliphatic diurea which is a reaction product of a cyclohexyl amine, an aliphatic amine, and a diisocyanate. Among them, a diurea compound is preferably contained in which any one of $R^1$ and $R^3$ is a cyclohexyl group and the other is preferably a saturated alkyl group having 12 to 22 carbon atoms, is more preferably a saturated alkyl group having 16 to 18 carbon atoms, and is even more preferably a saturated alkyl group having 18 carbon atoms. A particularly preferable one is a mixture of a diurea compound in which $R^1$ and $R^3$ are cycloalkyls, a diurea compound in which $R^1$ and $R^3$ are saturated alkyl groups having 18 carbon atoms, and a diurea compound in which one of $R^1$ and $R^3$ is a cycloalkyl and the other is a saturated alkyl group having 18 carbon atoms. In the alicyclic aliphatic diurea, a molar ratio between the cyclohexyl group and the alkyl group is preferably 10:90 to 50:50, and more preferably 20:80 to 40:60. When the molar ratio is within the above range, a larger amount of the base oil can be contained in the grease. This is preferable because the grease has good durability.

$R^2$ is preferably a group derived from a tolylene diisocyanate or diphenylmethane diisocyanate, is more preferably a group derived from a diphenylmethane diisocyanate, and is even more preferably a group derived from diphenylmethane-4,4'-diisocyanate.

The diurea compound of the formula (1) may be obtained by, for example, allowing a reaction of a particular diisocyanate with a particular monoamine to proceed in the base oil. Specific examples of the diisocyanate are diphenyl methane-4,4'-diisocyanate and tolylene diisocyanate. The monoamine is an aliphatic amine, an aromatic amine, an alicyclic amine, or a mixture of them. Specific examples of the aliphatic amine include octylamine, nonylamine, decylamine, undecylamine, dodecylamine, tridecylamine, tetradecylamine, pentadecylamine, hexadecylamine, heptadecylamine, octadecylamine, nonyldecylamine, eicodecylamine, oleylamine, and the like. Specific examples of the aromatic amine include aniline, p-toluidine, naphthyl amine, and the like. Specific examples of the alicyclic amine include cyclohexyl amine, dicyclohexyl amine, and the like.

The content of the thickener in the grease composition of the present invention varies depending on the type of the thickener. The cone penetration of the grease composition of the present invention is preferably 200 to 400, more preferably 200 to 300, and even more preferably 240 to 280. A preferable content of the thickener is a content with which the above cone penetration can be obtained. The content of the thickener in the grease composition of the present invention is usually 3 to 30% by mass, preferably 5 to 25% by mass, and more preferably 5 to 15% by mass.

<Additive>

[Antioxidant]

An antioxidant used in the present invention contains, as essential components, at least two types of antioxidants, namely, (c) an amine antioxidant and (d) a quinoline antioxidant.

A mass ratio between the (c) amine antioxidant and the (d) quinoline antioxidant is preferably 1:3 to 3:1.

As the (c) amine antioxidant, preferable ones are phenyl-α-naphthyl amine, alkyl phenyl-α-naphthyl amine, and alkyl diphenyl amine, and a more preferable one is an alkyl diphenyl amine.

As the (d) quinoline antioxidant, preferable ones are 2,2,4-trimethyl-1,2-dihydroquinoline, 2-methyl-2,4-di ethyl-1,2-dihydroquinoline, 2,2,4,6-tetramethyl-1,2-dihydroquinoline, 2,2,4,7-tetramethyl-1,2-dihydroquinoline, 6,6'-bis(2,2,4-trimethyl-1,2-dihydroquinoline), and derivatives thereof or polymers thereof. Also, there are various compounds having a structure represented by the following formula (2) and polymers thereof. As the polymer, there are poly(2,2,4-trimethyl-1,2-dihydroquinoline) [equivalent to an antidegradant TMDQ specified in JIS K6211 "Rubber Antidegradants", a specific gravity of 1.08 to 1.11, a softening point of 80 to 110° C., a ash content of 0.5% or less, and a loss on heating of 0.7% or less], 6-ethoxy-2,2,4-trimethyl-1,2-dihydroquinoline [equivalent to an antidegradant ETMDQ specified in the above JIS K6211 "Rubber Antidegradants"], and the like.

Among them, the poly(2,2,4-trimethyl-1,2-dihydroquinoline) is preferable. Here, n in the following formula (2) indicates that the compound is not composed of only monomers of 2,2,4-trimethyl-1,2-dihydroquinoline, but is a mixture also containing various condensates of dimers or higher n-mers of the compound (which may contain the monomers where n=1), although the specific numerical range of n is unknown.

(2)

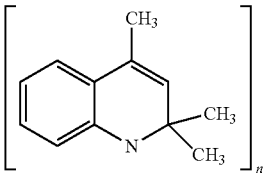

In a particularly preferable one, the (c) amine antioxidant is an alkyldiphenyl amine and the (d) quinoline antioxidant is a poly(2,2,4-trimethyl-1,2-dihydroquinoline).

The content of the (c) in the grease composition of the present invention is preferably 0.5 to 5% by mass and more preferably 0.5 to 2.5% by mass. When the content of the (c) is within the above range, the solubility to the base oil is favorable.

The content of the (d) in the grease composition of the present invention is preferably 0.5 to 5% by mass and more preferably 0.5 to 2.5% by mass. When the content of the (d) is within the above range, the solubility to the base oil is favorable.

The total amount of the (c) and the (d) is preferably 1 to 10% by mass and more preferably 2 to 5% by mass based on the total mass of the composition. When the total amount of the (c) and the (d) is within the above range, the antioxidant exerts a satisfactory antioxidant effect to prolong the bearing lubrication life and has favorable solubility to the base oil, so that the antioxidant does not adversely affect the bearing acoustic performance, which is one element in the basic performance of the grease, or the low temperature properties.

[Optional Additive]

The grease composition of the present invention may contain as needed various additives, which are usually used in the grease composition. Examples of these additives are antioxidants other than the above (c) and (d), rust inhibitors, metal deactivators, detergent dispersants, extreme pressure additives, defoamers, demulsifiers, oiliness improvers, antiwear agents, solid lubricants, and the like. An amount of each of these additives is usually 0.01 to 10% by mass.

The grease composition preferably contains a rust inhibitor, and more preferably contains a zinc rust inhibitor. It is particularly preferable that the rust inhibitor be zinc naphthenate. The content of the rust inhibitor is not particularly limited. In the case of zinc naphthenate, however, the content is preferably 0.5 to 10% by mass based on the total mass of the composition of the present invention. When such an amount of zinc naphthenate is contained, the grease composition can prevent rusting even in a test targeted for severe conditions as in Emcor rust prevention test (IP 220).

The grease composition of the present invention can be used for roll bearings that support motor rotors used in electrical instruments and mechanical parts used in various industries.

EXAMPLES

A grease composition containing an aromatic diurea as a thickener (Example 6) was prepared by: allowing a predetermined amount of 4,4'-diphenyl methane diisocyanate and a raw material amine (p-toluidine) at a molar ratio of 1:2 to react with each other in the base oil specified in Table presented below; adding predetermined amounts of an amine antioxidant, a quinoline antioxidant, and a zinc rust inhibitor thereto; and adjusting the mixture to have a specified cone penetration with a three roll mill.

Grease compositions each containing an alicyclic aliphatic diurea as a thickener (Examples 1 to 5 and 7 to 13, and Comparative Examples 4 to 9) were prepared in the same method as the grease composition in Example 6 except that a cyclohexyl amine and a stearyl amine are used as raw material amines in place of the p-toluidine.

Grease compositions each containing a lithium complex soap as a thickener (Comparative Examples 1 to 3) were prepared by: heating a mixture of the base oil with azelaic acid and 12-hydroxystearic acid; then adding an aqueous solution of lithium hydroxide to the mixture; followed by re-heating and then rapid cooling; adding predetermined amounts of the amine antioxidant, the quinoline antioxidant, and the zinc rust inhibitor thereto; and adjusting the mixture to have the specified cone penetration with the three roll mill.

Here, in all the grease compositions, the cone penetration (worked penetration after 60 strokes) was adjusted to 260 (JIS K2220).

(a) Base Oil

Mineral oil A: viscosity index: 95 or higher, a kinematic viscosity of 10.8 $mm^2/s$ at 100° C. and a kinematic viscosity of 96.6 $mm^2/s$ at 40° C.

Mineral oil B: viscosity index: 95 or higher, a kinematic viscosity of 11.2 $mm^2/s$ at 100° C. and a kinematic viscosity of 95.0 $mm^2/s$ at 40° C.

Mineral oil C: viscosity index: 95 or higher, a kinematic viscosity of 6.0 $mm^2/s$ at 100° C. and a kinematic viscosity of 37.0 $mm^2/s$ at 40° C.

Mineral oil D: viscosity index: 95 or higher, a kinematic viscosity of 31.6 $mm^2/s$ at 100° C. and a kinematic viscosity of 436 $mm^2/s$ at 40° C.

Highly refined mineral oil A: viscosity index: 120 or higher, a kinematic viscosity of 7.80 $mm^2/s$ at 100° C. and a kinematic viscosity of 46.0 $mm^2/s$ at 40° C.

(c) Amine Antioxidant

Alkyldiphenyl amine

Phenyl-α-naphthyl amine (d) Quinoline Antioxidant

Polymer of 2,2,4-trimethyl-1,2-dihydroquinoline (poly(2,2,4-trimethyl-1,2-dihydroquinoline) represented by the above formula (2)) [a specific gravity of 1.08 to 1.11, a softening point of 80 to 110° C., an ash content of 0.5% or less, and a loss on heating of 0.7% or less])

6-ethoxy-2,2,4-trimethyl-1,2-dihydroquinoline [equivalent to an antidegradant ETMDQ specified in the above JIS K6211 "Rubber Antidegradants"]

(e) Zinc Rust Inhibitor

Zinc naphthenate (f) Phenolic Antioxidant

Octadecyl-3-(3,5-di-t-butyl-4-hydroxyphenyl) propionate

<Text Methods and Evaluation>

[Durability (Heat Resistance and Bearing Lubrication Life)]

Evaluation Method

The test was carried out using a bearing lubrication life test machine in conformity with ASTM D3336.

The test conditions are presented below. Here, a time period until the motor generated an overcurrent (4 amperes or more) or a time period until the temperature of the bearing outer ring increased to a test temperature +15° C., whichever was shorter, was taken as the seizure life.

Bearing type: 6204 Metal seal

Test temperature: 160° C.

Rotation speed: 10000 rpm

Grease amount: 1.8 g

Test load: axial load of 66.7 N and radial load of 66.7 N

Evaluation

Bearing lubrication life 1000 hours or more . . . ○ (Passed)

Less than 1000 hours . . . x (Failed)

[Low Temperature Properties (Low Torque Properties)]

<Test Method>

The test of the low torque properties was carried out in conformity with the low-temperature torque test specified at the section 18. in JIS K2220.

Bearing type: 6204

Test temperature: −30° C.

Rotation speed: 1 rpm

Measured torques:

Starting torque (the maximum torque at the start of measurement)

Rotational torque (the average torque in the last 15 seconds for 10 minutes of rotation)

Evaluation Criteria

Starting torque (−30° C.) Less than 1000 mNm: Passed (○)

1000 mNm or more: Failed (x)

Rotational torque (−30° C.) Less than 100 mNm: Passed (○)

100 mNm or more: Failed (x)

[Overall Evaluation]

Passed in both the durability evaluation and the low torque property: ○ (Passed)

Failed in either one of the two evaluations: x (Failed)

TABLE 1

| | | | Example | | | | | | | | | |
|---|---|---|---|---|---|---|---|---|---|---|---|---|
| | | | 1 | 2 | 3 | 4 | 5 | 6 | 7 | 8 | 9 | 10 |
| (A) Thickener | Urea-based | Diphenylmethane Diisocyanate molar ratio | 50 | 50 | 50 | 50 | 50 | 50 | 50 | 50 | 50 | 50 |
| | | Cyclohexylamine molar ratio | 30 | 10 | 50 | 30 | 30 | — | 30 | 30 | 30 | 30 |
| | | Stearyl Amine molar ratio | 70 | 90 | 50 | 70 | 70 | — | 70 | 70 | 70 | 70 |
| | | Para-toluidine molar ratio | — | — | — | — | — | 100 | — | — | — | — |
| | Soap-based | Lithium Complex Soap | — | — | — | — | — | — | — | — | — | — |
| | Thickener Amount mass % | | 8.0 | 8.5 | 8.5 | 8.0 | 8.0 | 22.0 | 8.0 | 8.0 | 8.0 | 8.0 |
| Base Oil | Type (mass ratio) | Mineral Oil A | 50 | 50 | 50 | - | 10 | 50 | 50 | 50 | 50 | 50 |
| | | Mineral Oil B | 35 | 35 | 35 | 35 | 35 | 35 | 35 | 35 | 35 | 35 |
| | | Mineral Oil C | — | — | — | 50 | — | — | — | — | — | — |
| | | Mineral Oil D | — | — | — | — | 40 | — | — | — | — | — |
| | | Highly Refined Mineral Oil A | 15 | 15 | 15 | 15 | 15 | 15 | 15 | 15 | 15 | 15 |
| | kinematic viscosity $mm^2/s$ @40° C. | | 87.7 | 87.7 | 87.7 | 50.0 | 150.0 | 87.7 | 87.7 | 87.7 | 87.7 | 87.7 |
| Additive (mass %) | (c) Amine-based Antioxidant | Alkyldiphenyl Amine | 1.5 | 1.5 | 1.5 | 1.5 | 1.5 | 1.5 | 0.5 | 5.0 | 0.5 | 1.5 |
| | | Phenyl α-naphthyl Amine | — | — | — | — | — | — | — | — | — | — |
| | (d) Quinoline-based Antioxidant | Polymerizate of 2,2,4-trimethyl-1,2-dihydroquinoline | 1.5 | 1.5 | 1.5 | 1.5 | 1.5 | 1.5 | 0.5 | 5.0 | 1.5 | 0.5 |
| | | 6-ethoxy-2,2,4-trimethyl-1,2-dihydroquinoline | — | — | — | — | — | — | — | — | — | — |
| | (f) Phenolic Antioxidant | Octadecyl-3-(3,5-di-t-butyl-4-hydroxyphenyl) propionate | — | — | — | — | — | — | — | — | — | — |
| | (e) Zinc-based Rust Inhibitor | Zinc Naphthenate | 4.5 | 4.5 | 4.5 | 4.5 | 4.5 | 4.5 | 4.5 | 4.5 | 4.5 | 4.5 |
| | Worked Penetration | | 260 | 260 | 260 | 260 | 260 | 260 | 260 | 260 | 260 | 260 |
| Durability | Result | Bearing Lubrication Life, h 160° C. | 1300 | 1220 | 1220 | 1150 | 1350 | 1010 | 1010 | 1390 | 1090 | 1100 |
| | Evaluation | | ○ | ○ | ○ | ○ | ○ | ○ | ○ | ○ | ○ | ○ |
| Low Torque Properties | Result | Starting Torque mNm | 770 | 860 | 840 | 610 | 950 | 910 | 760 | 800 | 770 | 780 |
| | | Rotational Torque mNm | 76 | 85 | 83 | 62 | 93 | 90 | 74 | 79 | 77 | 79 |
| | Evaluation | Starting Torque | ○ | ○ | ○ | ○ | ○ | ○ | ○ | ○ | ○ | ○ |
| | | Rotational Torque | ○ | ○ | ○ | ○ | ○ | ○ | ○ | ○ | ○ | ○ |

TABLE 1-continued

| | | | | | | | | | | | | | | |
|---|---|---|---|---|---|---|---|---|---|---|---|---|---|---|
| Overall Evaluation | | | | | ○ | ○ | ○ | ○ | ○ | ○ | ○ | ○ | ○ | ○ |
| | | | | | Example | | | | | | | | | |
| | | | | | 11 | 12 | 13 | 14 | 15 | 16 | | | | |
| (A) Thickener | Urea-based | Diphenylmethane Diisocyanate molar ratio | | | 50 | 50 | 50 | 50 | 50 | 50 | | | | |
| | | Cyclohexylamine molar ratio | | | 30 | 30 | 30 | 30 | 30 | 30 | | | | |
| | | Stearyl Amine molar ratio | | | 70 | 70 | 70 | 70 | 70 | 70 | | | | |
| | | Para-toluidine molar ratio | | | — | — | — | — | — | — | | | | |
| | Soap-based | Lithium Complex Soap | | | — | — | — | — | — | — | | | | |
| | | Thickener Amount mass % | | | 8.0 | 8.0 | 8.0 | 8.0 | 8.0 | 8.0 | | | | |
| Base Oil | | Type (mass ratio) | Mineral Oil A | | 50 | 50 | 50 | 50 | 50 | 50 | | | | |
| | | | Mineral Oil B | | 35 | 35 | 35 | 35 | 35 | 35 | | | | |
| | | | Mineral Oil C | | 15 | — | 15 | — | — | — | | | | |
| | | | Mineral Oil D | | — | — | — | — | — | — | | | | |
| | | | Highly Refined Mineral Oil A | | — | 15 | — | 15 | 15 | 15 | | | | |
| | | kinematic viscosity $mm^2/s$ @40° C. | | | 85.2 | 87.7 | 85.2 | 87.7 | 87.7 | 87.7 | | | | |
| Additive (mass %) | | (c) Amine-based Antioxidant | Alkyldiphenyl Amine | | 1.5 | 1.5 | 1.5 | — | 1.5 | — | | | | |
| | | | Phenyl α-naphthyl Amine | | — | — | — | 1.5 | — | 1.5 | | | | |
| | | (d) Quinoline-based Antioxidant | Polymerizate of 2,2,4-trimethyl-1,2-dihydroquinoline | | 1.5 | 1.5 | 1.5 | 1.5 | — | — | | | | |
| | | | 6-ethoxy-2,2,4-trimethyl-1,2-dihydroquinoline | | — | — | — | — | 1.5 | 1.5 | | | | |
| | | (f) Phenolic Antioxidant | Octadecyl-3-(3,5-di-t-butyl-4-hydroxyphenyl) propionate | | — | — | — | — | — | — | | | | |
| | | (e) Zinc-based Rust Inhibitor | Zinc Naphthenate | | 4.5 | — | — | 4.5 | 4.5 | 4.5 | | | | |
| | | Worked Penetration | | | 260 | 260 | 260 | 260 | 260 | 260 | | | | |
| Durability | | Result | Bearing Lubrication Life, h 160° C. | | 1210 | 1220 | 1200 | 1220 | 1210 | 1190 | | | | |
| | | Evaluation | | | ○ | ○ | ○ | ○ | ○ | ○ | | | | |
| Low Torque Properties | | Result | Starting Torque mNm | | 920 | 790 | 930 | 780 | 790 | 780 | | | | |
| | | | Rotational Torque mNm | | 89 | 78 | 91 | 76 | 77 | 77 | | | | |
| | | Evaluation | Starting Torque | | ○ | ○ | ○ | ○ | ○ | ○ | | | | |
| | | | Rotational Torque | | ○ | ○ | ○ | ○ | ○ | ○ | | | | |
| | | Overall Evaluation | | | ○ | ○ | ○ | ○ | ○ | ○ | | | | |

TABLE 2

| | | | | | | | | | | | | | | |
|---|---|---|---|---|---|---|---|---|---|---|---|---|---|---|
| | | | | | Comparative Example | | | | | | | | | |
| | | | | | 1 | 2 | 3 | 4 | 5 | 6 | 7 | 8 | 9 | |
| (A) Thickener | Urea-based | Diphenylmethane Diisocyanate molar ratio | | | — | — | — | 50 | 50 | 50 | 50 | 50 | 50 | |
| | | Cyclohexylamine molar ratio | | | — | — | — | 30 | 30 | 30 | 30 | 30 | 30 | |
| | | Stearyl Amine molar ratio | | | — | — | — | 70 | 70 | 70 | 70 | 70 | 70 | |
| | | Para-toluidine molar ratio | | | — | — | — | — | — | — | — | — | — | |
| | Soap-based | Lithium Complex Soap | | | 100 | 100 | — | — | — | — | — | — | — | |
| | | Thickener Amount mass % | | | 10.0 | 10.0 | 10.0 | 8.0 | 8.0 | 8.0 | 8.0 | 8.0 | 8.0 | |
| Base Oil | | Type (mass ratio) | Mineral Oil A | | 50 | 50 | 50 | 50 | 50 | 50 | 50 | 50 | 50 | |
| | | | Mineral Oil B | | 35 | 35 | 35 | 35 | 35 | 35 | 35 | 35 | 35 | |
| | | | Mineral Oil C | | — | 15 | — | — | — | — | — | — | — | |
| | | | Mineral Oil D | | — | — | — | — | — | — | — | — | — | |
| | | | Highly Refined Mineral Oil A | | 15 | — | 15 | 15 | 15 | 15 | 15 | 15 | 15 | |
| | | kinematic viscosity (40° C.) $mm^2/s$ | | | 87.7 | 87.7 | 87.7 | 87.7 | 87.7 | 87.7 | 87.7 | 87.7 | 87.7 | |
| Additive (mass %) | | (c) Amine-based Antioxidant | Alkyldiphenyl Amine | | 1.5 | 1.5 | 1.5 | — | 1.5 | — | 3.0 | — | 1.5 | |
| | | (d) Quinoline-based Antioxidant | Polymerizate of 2,2,4-trimethyl-1,2-dihydroquinoline | | 1.5 | 1.5 | 1.5 | 1.5 | — | 3.0 | — | 1.5 | — | |
| | | (f) Phenolic Antioxidant | Octadecyl-3-(3,5-di-t-butyl-4-hydroxyphenyl) propionate | | — | — | — | — | — | — | — | 1.5 | 1.5 | |

TABLE 2-continued

| | | | Comparative Example | | | | | | | | |
|---|---|---|---|---|---|---|---|---|---|---|---|
| | | | 1 | 2 | 3 | 4 | 5 | 6 | 7 | 8 | 9 |
| | (e) Zinc-based Rust Inhibitor | Zinc Naphthenate | 4.5 | 4.5 | — | 4.5 | 4.5 | 4.5 | 4.5 | 4.5 | 4.5 |
| | Worked Penetration | | 260 | 260 | 260 | 260 | 260 | 260 | 260 | 260 | 260 |
| Durability | Result | Bearing Lubrication Life, h 160° C. | 400 | 380 | 370 | 700 | 650 | 770 | 750 | 910 | 880 |
| | Evaluation | | x | x | x | x | x | x | x | x | x |
| Low Torque Properties | Result | Starting Torque mNm | 790 | 1080 | 810 | 780 | 780 | 790 | 800 | 790 | 780 |
| | | Rotational Torque mNm | 78 | 110 | 80 | 79 | 77 | 78 | 80 | 78 | 77 |
| | Evaluation | Starting Torque | ○ | x | ○ | ○ | ○ | ○ | ○ | ○ | ○ |
| | | Rotational Torque | ○ | x | ○ | ○ | ○ | ○ | ○ | ○ | ○ |
| | Overall Evaluation | | x | x | x | x | x | x | x | x | x |

What is claimed is:

1. A grease composition comprising:

(a) a base oil at 70 to 90% by mass based on a total mass of the composition;

(b) a thickener comprising a urea compound at 5 to 25% by mass based on the total mass of the composition;

(c) an amine antioxidant at 0.5 to 5% by mass based on the total mass of the composition; and (d) a quinoline antioxidant at 0.5 to 5% by mass based on the total mass of the composition, wherein the base oil comprises 10 to 20% by mass of a highly refined mineral oil having a pour point of −35° C. or lower based on a total mass of the base oil, wherein the urea compound is a diurea compound represented by the following formula (1):

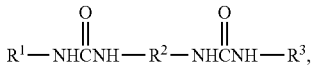

(1)

where $R^2$ is a divalent aromatic hydrocarbon group having 6 to 15 carbon atoms, and one of $R^1$ and $R^3$ is a saturated or unsaturated alkyl group having 6 to 30 carbon atoms, and the other is a cyclohexyl group, wherein the (c) amine antioxidant is alkyldiphenyl amine or phenyl-α-naphthyl amine, and wherein the (d) quinoline antioxidant is at least one quinoline antioxidant selected from the group consisting of 2,2,4-trimethyl-1,2-dihydroquinoline, 2-methyl-2,4-diethyl-1,2-dihydroquinoline, 2,2,4,6-tetramethyl-1,2-dihydroquinoline, 2,2,4,7-tetramethyl-1,2-dihydroquinoline, 6,6'-bis(2,2,4-trimethyl-1,2-dihydroquinoline), and homopolymers thereof.

2. The grease composition according to claim 1, wherein in the diurea compound, a molar ratio between the cyclohexyl group and the alkyl group is 10:90 to 50:50.

3. The grease composition according to claim 1, wherein the (a) base oil has a kinematic viscosity of 50 to 150 $mm^2/s$ at 40° C.

4. The grease composition according to claim 1, wherein a mass ratio between the (c) amine antioxidant and the (d) quinoline antioxidant is 1:3 to 3:1.

5. The grease composition according to claim 1, further comprising (e) a zinc rust inhibitor, wherein a content of the zinc rust inhibitor is 0.5 to 10% by mass based on the total mass of the grease composition.

6. The grease composition according to claim 1, which is for use for a rolling bearing for a motor which supports a rotor of the motor.

7. The grease composition according to claim 1, wherein the (c) amine antioxidant is alkyl diphenyl amine.

8. The grease composition according to claim 1, wherein the (d) quinoline antioxidant is a polymer of 2,2,4-trimethyl-1,2-dihydroquinoline.

9. The grease composition according to claim 1, wherein the thickener is an alicyclic aliphatic diurea which is a reaction product of a cyclohexyl amine, an aliphatic amine and a diisocyanate.

10. The grease composition according to claim 1, wherein the content of the (c) amine antioxidant is 0.5 to 2.5% by mass based on the total mass of the composition.

11. The grease composition according to claim 1, wherein the content of the (d) quinolone antioxidant is 0.5 to 2.5% by mass based on the total mass of the composition.

* * * * *